United States Patent [19]

Dupont

[11] Patent Number: 4,628,908

[45] Date of Patent: Dec. 16, 1986

[54] AIR INJECTION BATH FOR THERAPEUTIC USE

[75] Inventor: Robert J. Dupont, Paris, France

[73] Assignee: Techniques et Systems Elabores T.S.E., Paris, France

[21] Appl. No.: 542,335

[22] Filed: Oct. 17, 1983

[30] Foreign Application Priority Data

Oct. 18, 1982 [FR] France ..... 82 17417

[51] Int. Cl.[4] ..... A61H 29/00

[52] U.S. Cl. ..... 128/24.1; 128/66; 137/881

[58] Field of Search ..... 128/24.1, 65, 66; 4/541, 542; 137/861, 877, 878, 879, 881, 887

[56] References Cited

U.S. PATENT DOCUMENTS

| | | | |
|---|---|---|---|
| 2,344,492 | 3/1944 | Brubaker | 137/881 X |
| 2,778,375 | 1/1957 | Hans-Martin Pape et al. | 137/878 X |
| 2,856,611 | 10/1958 | Velonis | 128/66 X |
| 2,982,304 | 5/1961 | Bauerlein | 137/881 |
| 4,237,562 | 12/1980 | DuPont | 128/66 X |
| 4,338,731 | 7/1982 | Shames et al. | 137/881 X |
| 4,340,039 | 7/1982 | Hibbard et al. | 128/66 |

*Primary Examiner*—Richard J. Apley
*Assistant Examiner*—Robert W. Bahr
*Attorney, Agent, or Firm*—Seidel, Gonda, Goldhammer & Abbott

[57] ABSTRACT

This invention relates to an air injection bath for a therapeutic use, the bath comprising a tub having in its base air injection nozzles supplied by a turbine, heating and ozonizing devices being disposed in a box outside the safety perimeter of the bath, the box having an electric and electronic control system receiving air pulses from a mobile control grip or from a stationary control panel disposed near the user for controlling various operations for air injection, heating of the injected air, ozone injection, the direction and speed of air injection into the bath and the starting and stopping of the complete facility.

8 Claims, 2 Drawing Figures

AIR INJECTION BATH FOR THERAPEUTIC USE

BACKGROUND OF INVENTION

The invention relates to an air injection bath for therapeutic use, of a kind such as to enable the user to be massaged by turbulence produced in a bath by an injection of air.

Air injection baths for the uses specified and having a tube whose base has air injection nozzles are known. Heated and ozonised air is injected by a turbine. The box in which these various devices are disposed is placed outside the safety perimeter of the bath and has electric and electronic controls receiving air pulses from either a mobile control grip or a stationary control panel. The grip or panel are disposed near the user to give him the facility of remote control, for instance, of air injection, air heating, ozone, the duration and speed of injection and stoppage. However, a disadvantage found is that the user must get out of the bath and go to the control box to adjust the air intake and more particularly the force of air injection or starting, stopping and heating of the injected air when these controls have to be carried out on a stationary panel disposed at a distance from the bath.

It is the object of this invention to obviate these disadvantages and the invention proposes an air injection bath of use for balneotherapy or thalassotherapy with an appreciable increase in user convenience by enabling the user to control various operations without leaving the bath, the means for adjusting and controlling the bath being readily fittable and readily accessible yet very effective and without any risk for the user and not running any risk of causing overflows.

BRIEF SUMMARY OF THE INVENTION

Accordingly, the invention relates to an air injection bath according to claim 2.

The user can therefore control as he wishes air injection and heating and the force with which air is injected into the bath without leaving the same, because the valve control element is near at hand.

The silencer on the bypass tube provides very effective damping of the noise caused by air flowing through such tube and discharging therefrom.

By means of the air discharge system and its special form of connection, excess compressed air entering the bypass tube can be removed very conveniently and can be used with advantage.

The valve control element gives very accurate adjustment of the force of the injected air.

The special feature of control by compressed air pulses increases the safety of the person taking a bath since nothing electrical requiring handling or equipment needing electricity is placed near the bath.

This invention will be more clearly understood with reference to an embodiment shown in the drawings wherein:

DESCRIPTION OF THE PREFERRED EMBODIMENTS

Figure 2:
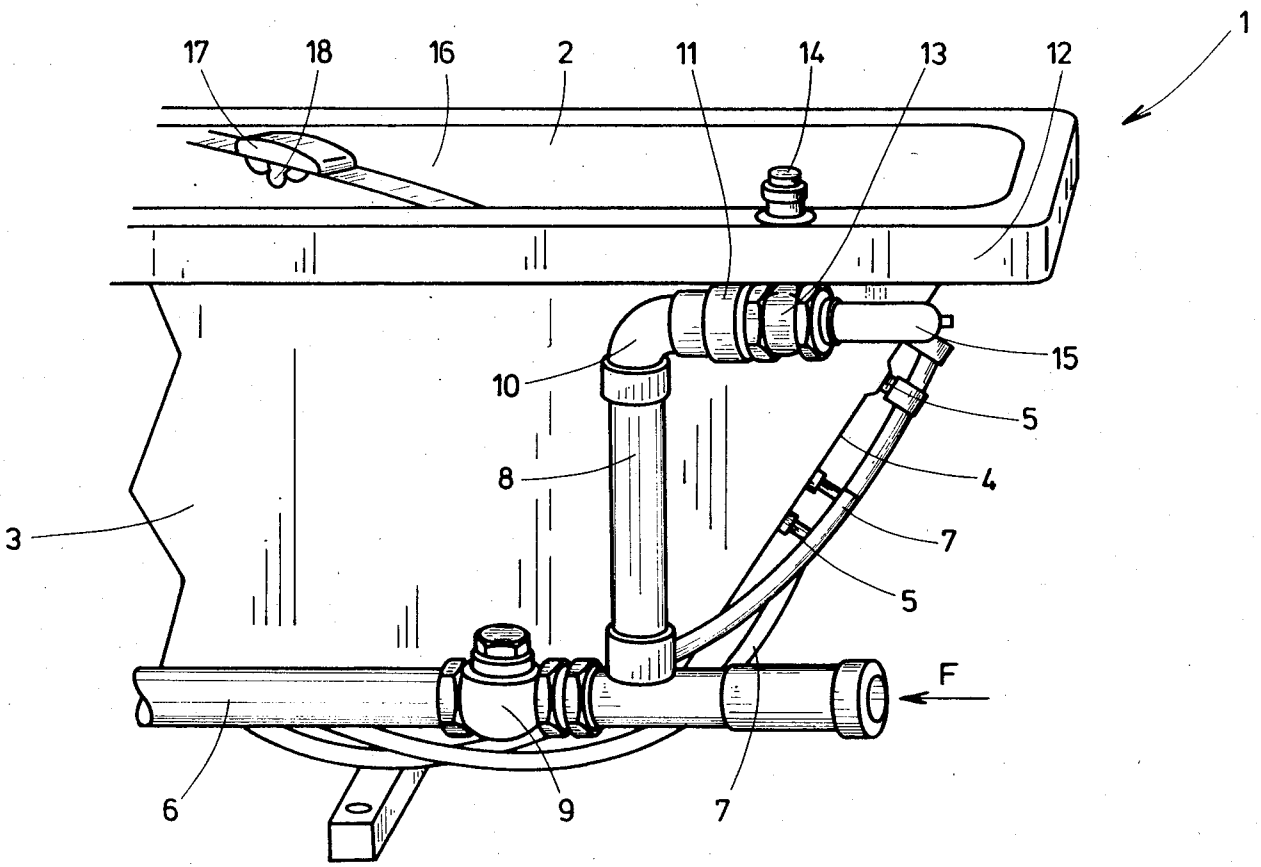
FIG. 2 is a perspective view of a constructional variant.

Referring to FIG. 2, a bath 1 comprises a tub 2; the same has in its base and in end walls 4 air injection nozzles 5 connected to a mains 6 by flexible hoses 7. Air enters the header 6 in the direction indicated by an arrow F. The bath 1 also comprises a box (not shown) having a number of control elements and facilities: the box is disposed outside the safety perimeter of the bath 1. The box also comprises a turbine for producing compressed air, an air heater, an ozone generator and a system of electric and electronic controls receiving pneumatic pulses. The same are transmitted from a mobile control grip or from a stationary control panel disposed near the bath. The box helps to control various operations relating to the injection and heating of the injected air, ozone injection, the duration and rate of injection of air into the bath and starting and stopping.

The bath 1 has provision for controlling the entry of air into the water to produce varying degrees of turbulence. Such means comprise a bypass tube 8 connected to the mains 6 upstream of a check valve 9. The tube 8 has an elbow 10 so that tube end 11 is substantially at the top edge 12 of the bath 1. A valve 13 at tube end 11 is operated by an adjusting element 14 extending through the bath top edge 12. The valve 13 disposed near the free end 11 of the tube 8 is a straight-through valve. The valve control element 14 is readily accessible to, and manipulated by, the user to give very accurate control of the force of the air injected into the bath water.

At its free end the bypass tube 8 has a silencer 15 giving very effective damping of the sound of the air flowing through the tube 8 and valve 13. The silencer 15, adapted more particularly to compressed air, is made of sintered bronze.

The bath side walls and inside walls 16 have pneumatic control grips 17, only one of which is shown, the other being disposed on the opposite bath surface. The grips 17 are associated with air bellows 18. The user presses the grips 17 to transmit control pulses to the box (not shown). One of the grips 17 enables the user to control starting and stopping of air injection and the other grip 17 enables him to control the heating of the air injected into the water.

Figure 1:
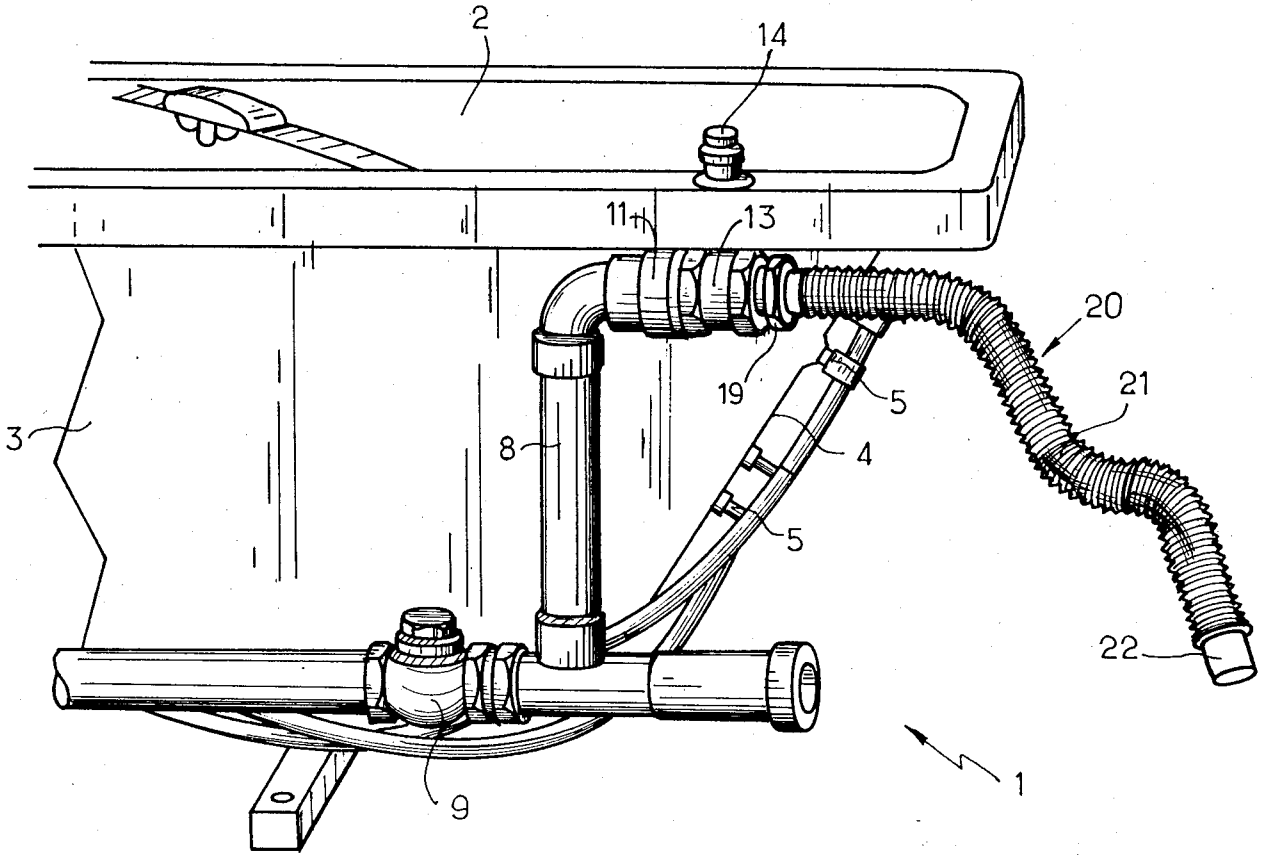
FIG. 1 is a partial perspective view of an air injection bath according to the present invention.

Referring to the alternative embodiment shown in FIG. 1, tube end 11 has means 20 for discharging the excess compressed air for injection produced by the turbine. The means 20 comprise a check valve 19 on the straight-through valve 13 and a flexible hose 21 having a ferrule or thimble or the like 22 at its free end. The hose 21 and valve 19 are disposed immediately after the valve 13.

The ferrule 22 can be connected in three different ways to discharge excess compressed air injected into the tube 8:

(a) The ferrule 22 can be fitted in the wall of the room where the bath is situated so as to communicate with the exterior;

(b) The ferrule 22 can be connected to the means for ventilating the room where the bath 2 is disposed;

(c) The ferrule 22 is connected to the bath waste pipe.

The discharge means embodied by the valve 19 and hose 21 obviate any risk of leakage should water accidentally enter the tube 8 while the bath is filling due to an oversight on the part of the user.

Also, the means 20 help to reduce the noise of the compressed air flowing through the tube 8. The surplus compressed air not injected into the bath can also be removed by special adjustment of the element 14 either to atmosphere outside the room or to the means for ventilating the same or to the bath waste pipe.

I claim:

1. An air injection bath, said bath comprising:

a tub having a base with air injection nozzles disposed in said base, said air injection nozzles being supplied by a turbine;

heating and ozonising means being disposed in a box, said box having an electrical control system and being located outside the safety perimeter of the bath;

a pneumatic control grip connected to said box and being disposed near the user, said pneumatic control grip sending air pulses to said box for controlling various operations for air injection, heating of the injected air, ozone injection, the duration and speed of the air injected into the bath, and the starting and stopping of the complete facility;

control means for controlling the flow of air to the air injection nozzles, said control means including a bypass tube, an adjustable control valve being substantially at the top-edge of the bath, and an elbow connecting said bypass tube to said adjustable control valve, wherein the amount of air entering the bypass tube, thus bypassing the air injection nozzles, is controlled by the adjustable control valve.

2. A bath according to claim 1 wherein the bypass tube (8) is connected to an air distribution main (6) upstream of a check valve (9).

3. A bath according to claim 1 wherein the adjustable control valve has an exhaust silencer.

4. A bath according to claim 1 wherein the adjustable control valve (13) is a straight-through valve.

5. A bath according to claim 1, wherein said adjustable control valve has a valve control element for controlling the force of the injected air, said valve control element extending through the top edge of the bath (1) in order to be readily accessible to and manipulated by the user.

6. A bath according to claim 1, wherein the pneumatic control grips (17) have air bellows (18) for transmitting control pulses to the box.

7. A bath according to claim 1, wherein the pneumatic control grips (17) are secured to a surface (16) of the bathtub (2).

8. A bath according to claim 1 wherein the control means includes means for discharging the air entering the bypass tube, said means including a check valve disposed after the adjustable control valve, a flexible hose connected to said check valve, and a connecting ferrule connected to the flexible hose.

* * * * *